US009759058B2

(12) United States Patent
Tjhang

(10) Patent No.: US 9,759,058 B2
(45) Date of Patent: Sep. 12, 2017

(54) SYSTEMS AND METHODS FOR DETECTING MOVEMENT OF DRILLING/LOGGING EQUIPMENT

(71) Applicant: Schlumberger Technology Corporation, Sugar Land, TX (US)

(72) Inventor: Theodorus Tjhang, Sagamihara-shi (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 757 days.

(21) Appl. No.: 14/031,049

(22) Filed: Sep. 19, 2013

(65) Prior Publication Data

US 2015/0075866 A1 Mar. 19, 2015

(51) Int. Cl.
*E21B 44/00* (2006.01)

(52) U.S. Cl.
CPC ..... *E21B 44/00* (2013.01)

(58) Field of Classification Search
CPC ..... E21B 45/00; E21B 47/0002; E21B 47/04; E21B 44/00; E21B 47/00
See application file for complete search history.

(56) References Cited

U.S. PATENT DOCUMENTS 2,655,633 A * 10/1953 Minor ..... E21B 47/04 324/206
3,913,840 A 10/1975 Kato
4,187,868 A 2/1980 Rudolphi
4,309,609 A * 1/1982 Sampson ..... G01B 11/043 250/341.6
4,444,146 A 4/1984 De Witz et al.
4,777,368 A * 10/1988 Kerlin, Jr. ..... G01P 3/806 250/341.6
5,107,705 A * 4/1992 Wraight ..... E21B 19/20 348/85
5,296,256 A * 3/1994 Hartman ..... B05B 9/06 427/10
5,440,081 A 8/1995 Thompson
6,437,326 B1 8/2002 Yamate et al.
(Continued)

OTHER PUBLICATIONS

International Search Report and Written Opinion issued in related International application PCT/US2014/056529 dated Dec. 30, 2014 14 pages.

(Continued)

*Primary Examiner* — Jennifer H Gay

(57) ABSTRACT

Remote sensing systems and methods for analyzing characteristics of moving drilling equipment, for example, rotational movement rate, longitudinal movement rate, geometry or combinations thereof, are provided. The sensing systems may include a detectable substance, marking equipment for marking the drilling equipment with the detectable substance, detection equipment for detecting the detectable substance and capturing data from which drilling equipment movement and/or geometry may be estimated, and processing equipment for estimating movement and/or geometry information from the captured data. The methods include marking the drilling equipment with a detectable substance, detecting the detectable substance, and using data captured during the detection to analyze movement and geometry of the drilling equipment.

13 Claims, 6 Drawing Sheets

(56) References Cited

U.S. PATENT DOCUMENTS

| | | | | |
|---|---|---|---|---|
| 6,563,303 | B1 * | 5/2003 | Watkins | E21B 47/04 324/206 |
| 7,114,562 | B2 | 10/2006 | Fisseler et al. | |
| 7,346,455 | B2 * | 3/2008 | Ward | E21B 43/127 175/45 |
| 7,518,526 | B2 * | 4/2009 | Newman | E21B 19/00 166/53 |
| 7,571,054 | B2 * | 8/2009 | Newman | E21B 17/00 235/449 |
| 9,511,394 | B2 | 12/2016 | Atsumi et al. | |
| 9,584,711 | B2 | 2/2017 | Tjhang et al. | |
| 2003/0155001 | A1 | 8/2003 | Hoetzer et al. | |
| 2007/0282253 | A1 | 12/2007 | Sasaki | |
| 2012/0148227 | A1 | 6/2012 | Schmit et al. | |
| 2012/0212326 | A1 * | 8/2012 | Christiansen | H04Q 9/00 340/10.1 |

OTHER PUBLICATIONS

International Preliminary Report on Patentability issued in related International application PCT/US2014/056529 dated Mar. 31, 2016. 11 pages.

Wantanabe et al., Real-time visual measurements using high-speed vision. SPIE Proceedings vol. 5603. Oct. 25, 2004. 9 pages.

Mostowfi et al., Determining phase diagrams of gas-liquid systems using a microfluidic PVT. The Royal Society of Chemistry. Lab Chip vol. 12. pp. 4381-4387. 2012.

Non-Final Office Action issued in related U.S. Appl. No. 14/031,048 dated Jan. 29, 2016. 9 pages.

Final Office Action issued in related U.S. Appl. No. 14/031,048 dated Jul. 1, 2016. 16 pages.

Non-Final Office Action issued in related U.S. Appl. No. 14/031,048 dated Nov. 9, 2016. 17 pages.

Final Office Action issued in related U.S. Appl. No. 14/031,048 dated Apr. 24, 2017. 19 pages.

* cited by examiner

SYSTEMS AND METHODS FOR DETECTING MOVEMENT OF DRILLING/LOGGING EQUIPMENT

FIELD OF THE DISCLOSURE

This disclosure relates to oilfield imaging systems and methods. This disclosure also relates to oilfield systems and methods for estimating drilling equipment characteristics such rate of movement and geometry.

BACKGROUND

Remote sensing of the movement of drilling equipment can provide useful information to oil and gas industry professionals. For example, remote sensing of longitudinal movement of the drill string can be correlated to provide the distance from the bottom of the drill string to the well bottom. Currently there is no effective remote sensing of drilling equipment measurement, and practically the measurement is done manually by measuring and counting the drill pipes or by estimating the displacement of the drill pipe indirectly from the top-drive movement. If an error occurs and a drill pipe segment is missed, it may lead to catastrophic consequences such as the drill string hitting the bottom of the well.

SUMMARY

The present disclosure relates to methods and systems for remotely making measurements corresponding to characteristics of drilling/logging equipment, such as the movement of drilling/logging equipment and/or the geometry/shape of the drilling/logging equipment. For example the present disclosure relates to methods and systems for remotely measuring the rate of rotational movement, the rate of axial movement, or both of the drilling/logging equipment. In some or additional embodiments, the present disclosure relates to methods and systems for remotely measuring the diameter and/or length profile of a drill pipe section or each section of drill pipe. The present disclosure also relates to methods and systems for making measurements at surface and/or downhole, which measurements can be used to estimate characteristics of the drilling/logging equipment such as the movement and/or geometry/shape of the drilling/logging equipment (which may be downhole moving mechanical parts). For example, the disclosure relates to methods and systems for making measurements at surface and/or downhole which can be used to estimate the rate of rotational movement, the rate of axial movement or both of the drilling/logging equipment. In some or additional embodiments, the present disclosure also relates to methods and systems for making measurements at surface and/or downhole which can be used to estimate the diameter and/or length profile of section(s) of drill equipment (e.g. drill pipe).

In some embodiments, the methods for analyzing the movement of drilling/logging equipment involves marking the drilling equipment with a detectable substance resulting in a mark; capturing a first set of data relating to the mark with a detector when the mark moves through the detector's field-of-view and is at a first location in the field-of-view; capturing a second set of data relating to the mark also with the detector when the mark continues to move through the field-of-view from the first location; and, estimating the longitudinal movement rate, the rotational movement rate, or both of the equipment from the first data and the second data. In some embodiments, the drilling/logging equipment may be drilling pipe, coiled tubing, slick line or logging cable. In some embodiments, marking the drilling/logging equipment and capturing data are accomplished at surface such as on a rig floor. On the rig, the rotating and moving up-down drilling/logging equipment is marked with the detectable substance on the drilling/logging equipment surface and the detector captures the moving image of the mark along with the movement (rotation or up-down movement) of drilling/logging equipment before they are conveyed-down to the hole. In further embodiments, the method of marking the moving mechanical parts and capturing data can also be accomplished downhole such as to observe a moving part (e.g. valves), and/or the moving motor shaft inside a logging tool or drilling tool.

In some embodiments, the detectable substance may be paint, a radiation dye, a fluorescent dye, or a heat or infrared mark and the detector may be, correspondingly, a camera, an x-ray detector, a fluorescence detector, or a heat or infrared detector. In some embodiments, the detectable substance is a substance that reflects single and/or multiple wavelength (spectrum) light. For example, the substance may emit both visible light and also light in the infrared, ultraviolet, or even gamma ray or x-ray spectrum. Thus for example, the detectable substance may be a colored paint that also emits infrared or another electromagnetic (light) wavelength. In some embodiments, the detector is a high-speed camera and marking involves injecting spray paint onto the drilling/logging equipment or downhole moving mechanical part. In some embodiments the first set of data and the second set of data provide 2-D data, for example the detector may be a camera including multiple photodetectors (in a photodetector array) in order to capture 2-D data. In further embodiments, the detectors may comprise multiple cameras (multiple photodetector arrays) to capture the target image from different angles of view (e.g. expansion to obtain a target's 3D information). In further embodiments, the methods also involve flowing fluid (such as a non-combustible gas: CO2, N2 etc) across the detector surface, for example to protect (e.g. repel any debris, dirt flying into the detector surface) the detector surface and/or to clean the detector surface. In other or additional embodiments, the methods also involve illuminating the target (the mark) with an illumination system, for example when the mark is in the detector's field of view.

In some embodiments, the systems include a detector (which may be configured for use downhole) for detecting a detectable substance, a detectable substance such as paint, a fluorescent dye, a radioactive dye, or a heat or infrared mark, an injector for making a mark on the drilling equipment with the detectable substance (and in some embodiments is configured for use downhole), and a processor for estimating movement such as longitudinal movement, rotational movement, or both of the drilling equipment from data captured by the detector. In further embodiments the detector can be a high-speed camera such as a high-speed video camera which can capture at least two images of the mark on the drilling equipment as it moves through the camera's field-of-view. In further embodiments, the processor may comprise a plurality of processing elements associated with each of the photodetectors to perform pixel parallel image processing in real-time. In further embodiments, systems wherein the detector is a camera, also include an illumination system to illuminate target objects in the optical field-of-view. In some embodiments, the illumination system may cover the ultraviolet spectrum when a fluorescent dye is used for the mark. In some embodiments, the system also includes a fluid flowing system to create a continuous flow of transparent fluid on the surface of the detector in order to protect the detector from getting dirty and to clean the detector surface.

The identified embodiments are exemplary only and are therefore non-limiting. The details of one or more non-limiting embodiments of the invention are set forth in the accompanying drawings and the descriptions below. Other embodiments of the invention should be apparent to those of ordinary skill in the art after consideration of the present disclosure.

BRIEF DESCRIPTION OF THE DRAWINGS

Non-limiting example downhole imaging methods and systems are described with reference to the following figures. The same numbers may be used throughout the figures to reference like features and components.

FIG. 4*a* is a schematic illustration of an embodiment of a detector system, specifically a camera system, whereas

DETAILED DESCRIPTION

Figure 1:
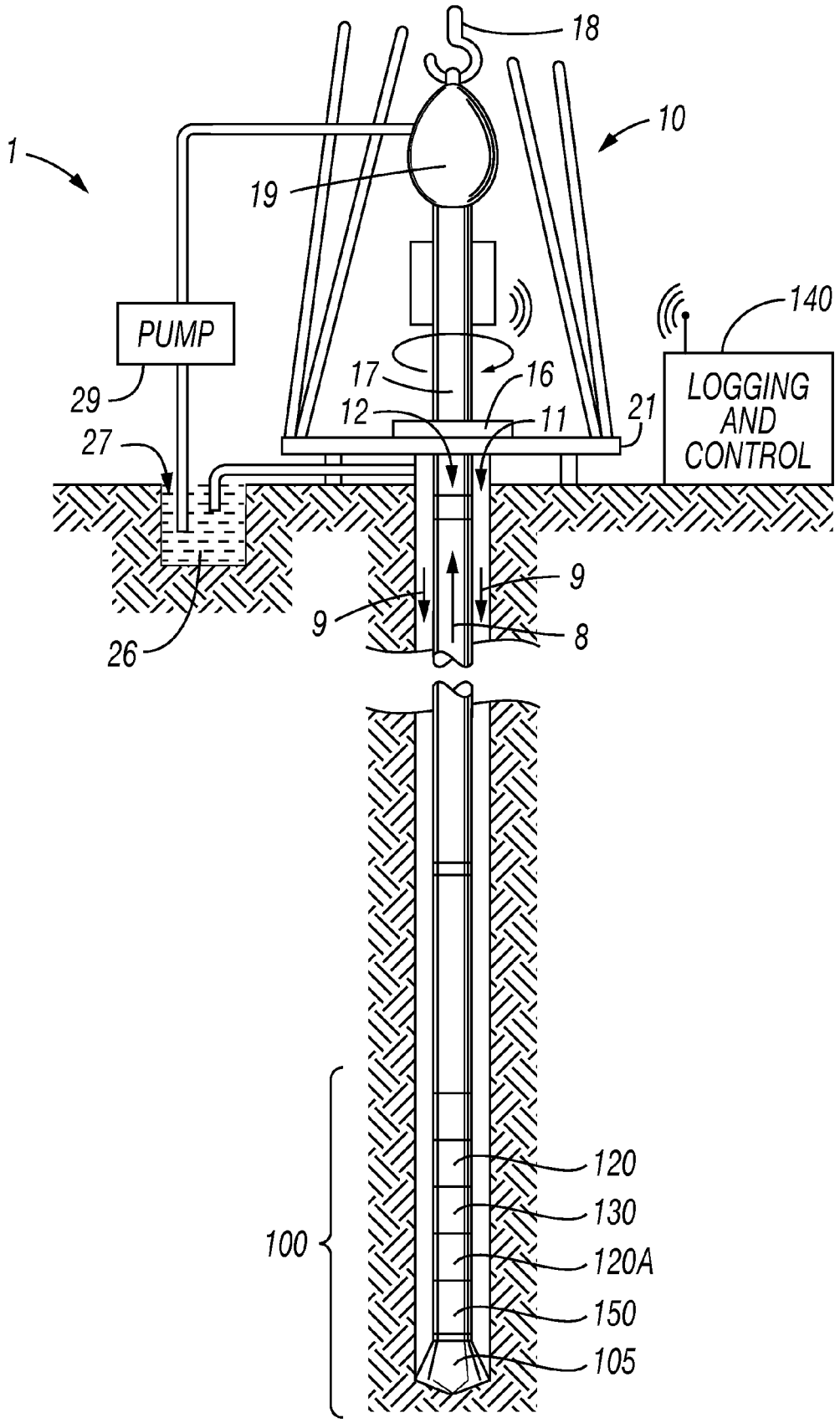
FIG. 1 is a block diagram illustrating an embodiment of a wellsite system in which remote sensing systems and methods according to this disclosure may be implemented.

In the following detailed description, reference is made to the accompanying drawings, which form a part hereof, and within which are shown by way of illustration certain embodiments by which the subject matter of this disclosure may be practiced. It is to be understood that other embodiments may be utilized and structural changes may be made without departing from the scope of the disclosure. In other words, illustrative embodiments and aspects are described below. But it will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such development effort might be complex and time-consuming, but would nevertheless be a routine undertaking for those of ordinary skill in the art having the benefit of this disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrases "for example," "such as," "including" and the like are used herein, the phrase "and without limitation" is understood to follow unless explicitly stated otherwise.

The terms "comprising" and "including" and "involving" (and similarly "comprises" and "includes" and "involves") are used interchangeably and mean the same thing. Specifically, each of the terms is defined consistent with the common United States patent law definition of "comprising" and is therefore interpreted to be an open term meaning "at least the following" and is also interpreted not to exclude additional features, limitations, aspects, etc.

The term "drilling equipment" broadly refers to drilling equipment, logging equipment and movable parts (such as valves, motor shafts) of drilling and logging equipment or subset thereof as contextually appropriate.

The term "about" is meant to account for variations due to experimental error. All measurements or numbers are implicitly understood to be modified by the word about, even if the measurement or number is not explicitly modified by the word about.

The term "substantially" (or alternatively "effectively") is meant to permit deviations from the descriptive term that don't negatively impact the intended purpose. Descriptive terms are implicitly understood to be modified by the word substantially, even if the term is not explicitly modified by the word substantially.

"Measurement While Drilling" ("MWD") can refer to devices for measuring downhole conditions including the movement and location of the drilling assembly contemporaneously with the drilling of the well. "Logging While Drilling" ("LWD") can refer to devices concentrating more on the measurement of formation parameters. While distinctions may exist between these terms, they are also often used interchangeably. For purposes of this disclosure MWD and LWD are used interchangeably and have the same meaning. That is, both terms are understood as related to the collection of downhole information generally, to include, for example, both the collection of information relating to the movement and position of the drilling assembly and the collection of formation parameters.

The present disclosure relates to remote sensing systems and methods for capturing data downhole relating to the movement of drilling equipment such as the rotational movement, longitudinal movement or both of the drilling equipment. Turning to the figures, FIG. 1 illustrates an embodiment of a wellsite system 1 in which remote sensing methods and systems disclosed herein can be employed. The wellsite can be onshore or offshore. In illustrated system, a borehole 11 is formed in subsurface formations by rotary drilling however other drilling systems can be used with the remote sensing systems and methods of this disclosure, such as directional drilling systems and coiled tubing systems.

A drillstring 12 is suspended within the borehole 11 and has a bottom hole assembly 100 that includes a drill bit 105 at its lower end. The surface system includes platform and derrick assembly 10 positioned over the borehole 11, the assembly 10 including a rotary table 16, kelly 17, hook 18 and rotary swivel 19. In an example, the drill string 12 is suspended from a lifting gear (not shown) via the hook 18, with the lifting gear being coupled to a mast (not shown) rising above the surface. An example lifting gear includes a crown block whose axis is affixed to the top of the mast, a vertically traveling block to which the hook 18 is attached, and a cable passing through the crown block and the vertically traveling block. In such an example, one end of the cable is affixed to an anchor point, whereas the other end is affixed to a winch to raise and lower the hook 18 and the drillstring 12 coupled thereto. The drillstring 12 is formed of drill pipes screwed one to another.

The drillstring 12 may be raised and lowered by turning the lifting gear with the winch. In some scenarios, drill pipe raising and lowering operations require the drillstring 12 to be unhooked temporarily from the lifting gear. In such scenarios, the drillstring 12 can be supported by blocking it with wedges in a conical recess of the rotary table 16, which is mounted on a platform 21 through which the drillstring 12 passes.

In the illustrated example, the drillstring 12 is rotated by the rotary table 16, energized by means not shown, which engages the kelly 17 at the upper end of the drillstring 12. The drillstring 12 is suspended from the hook 18, attached to a traveling block (also not shown), through the kelly 17 and the rotary swivel 19, which permits rotation of the drillstring 12 relative to the hook 18. In some examples, a top drive system could be used.

In the illustrated example, the surface system further includes drilling fluid or mud 26 stored in a pit 27 formed at the well site. A pump 29 delivers the drilling fluid 26 to the interior of the drillstring 12 via a hose 20 coupled to a port in the swivel 19, causing the drilling fluid to flow downwardly through the drillstring 12 as indicated by the directional arrow 8. The drilling fluid exits the drillstring 12 via ports in the drill bit 105, and then circulates upwardly through the annulus region between the outside of the drillstring and the wall of the borehole, as indicated by the directional arrows 9. In this manner, the drilling fluid lubricates the drill bit 105 and carries formation cuttings up to the surface as it is returned to the pit 27 for recirculation.

The bottom hole assembly 100 includes one or more specially-made drill collars near the drill bit 105. Each such drill collar has one or more logging devices mounted on or in it, thereby allowing downhole drilling conditions and/or various characteristic properties of the geological formation (e.g., such as layers of rock or other material) intersected by the borehole 11 to be measured as the borehole 11 is deepened. In particular, the bottom hole assembly 100 of the illustrated example system 1 includes a logging-while-drilling (LWD) module 120, a measuring-while-drilling (MWD) module 130, a roto-steerable system and motor 150, and the drill bit 105.

The LWD module 120 is housed in a drill collar and can contain one or a plurality of logging tools. It will also be understood that more than one LWD and/or MWD module can be employed, e.g. as represented at 120A. (References, throughout, to a module at the position of 120 can mean a module at the position of 120A as well.) The LWD module 120 may include capabilities for measuring, processing, and storing information, as well as for communicating with the surface equipment.

The MWD module 130 is also housed in a drill collar and may contain one or more devices for measuring characteristics of the drillstring 12 and drill bit 105. The MWD module 130 may further include an apparatus (not shown) for generating electrical power to the downhole system. This may include a mud turbine generator powered by the flow of the drilling fluid, it being understood that other power and/or battery systems may be employed. In the illustrated example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The wellsite system 1 also includes a logging and control unit 140 communicably coupled in any appropriate manner to the LWD module 120/120A and the MWD module 130. The logging and control unit 140 may also be communicatively coupled to imaging systems in accordance with the disclosure to implement certain embodiments of this disclosure, such as controlling marking of the drilling equipment, controlling cleaning of field of view/detector using a jet-flushing system, controlling target illumination using an illumination system, controlling image capture, and data processing. In some embodiments, the LWD module 120/120A and/or the MWD module 130, in conjunction with the logging and control unit 140, collectively implement certain embodiments of systems and methods consistent with this disclosure. For example, the LWD module 120/120A and/or the MWD module 130 may include an imaging assembly and a flushing assembly. Acquired images may be pre-processed downhole, for example by an image processor associated with the downhole imaging system, prior to transmission to surface. Although embodiments disclosed herein are described in the context of LWD and MWD applications, they are not limited thereto. Instead, for example, they may also be used in other applications, such as wireline logging, production logging, permanent logging, fluid analysis, formation evaluation, sampling-while-drilling, etc.

The remote sensing systems and methods of this disclosure are designed to provide data useful for estimating characteristics of logging/drilling equipment and/or moving mechanical parts ("drilling equipment") such as the movement of the drilling equipment and/or the geometry/shape ("geometry") of the drilling equipment, for example the rotational movement, longitudinal movement or both of the drilling equipment, and/or the diameter and/or the length of drilling equipment (e.g. drill pipe sections). General features of certain embodiments of remote sensing methods and systems of this disclosure are illustrated in FIGS. 2-6.

Figure 3:
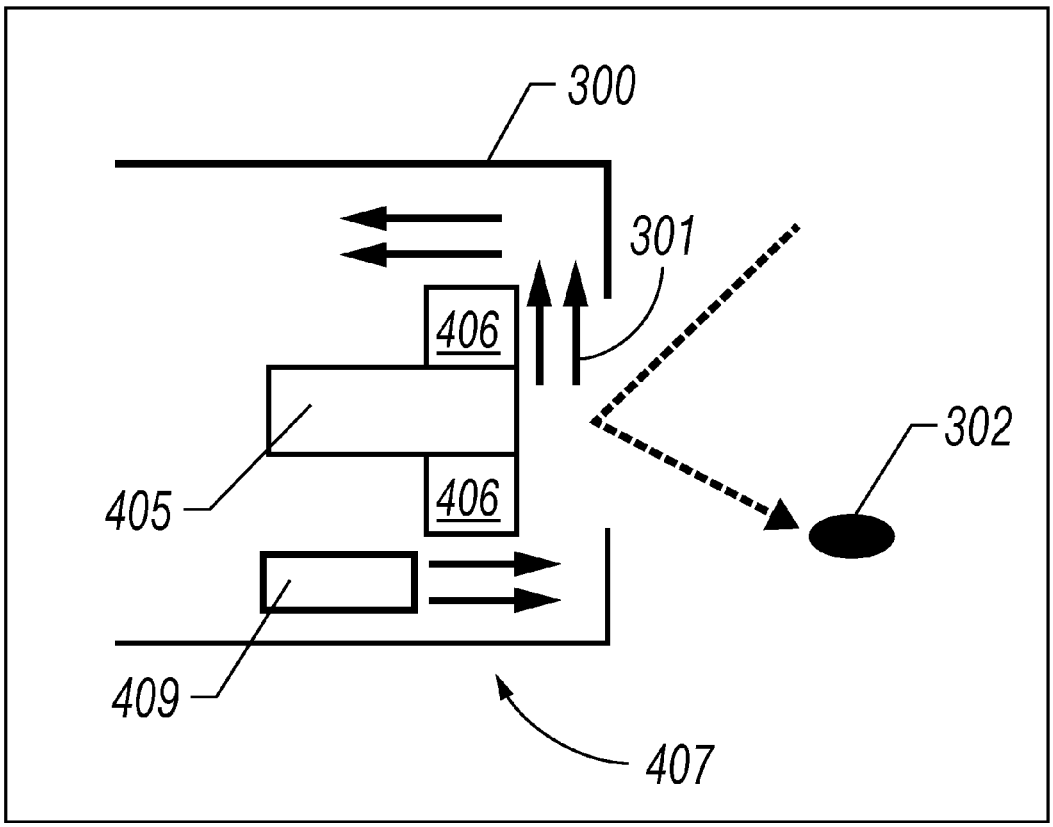
FIG. 3 is a schematic illustration of a detector system with a protective fluid flow and protective cap.
Figure 4A:
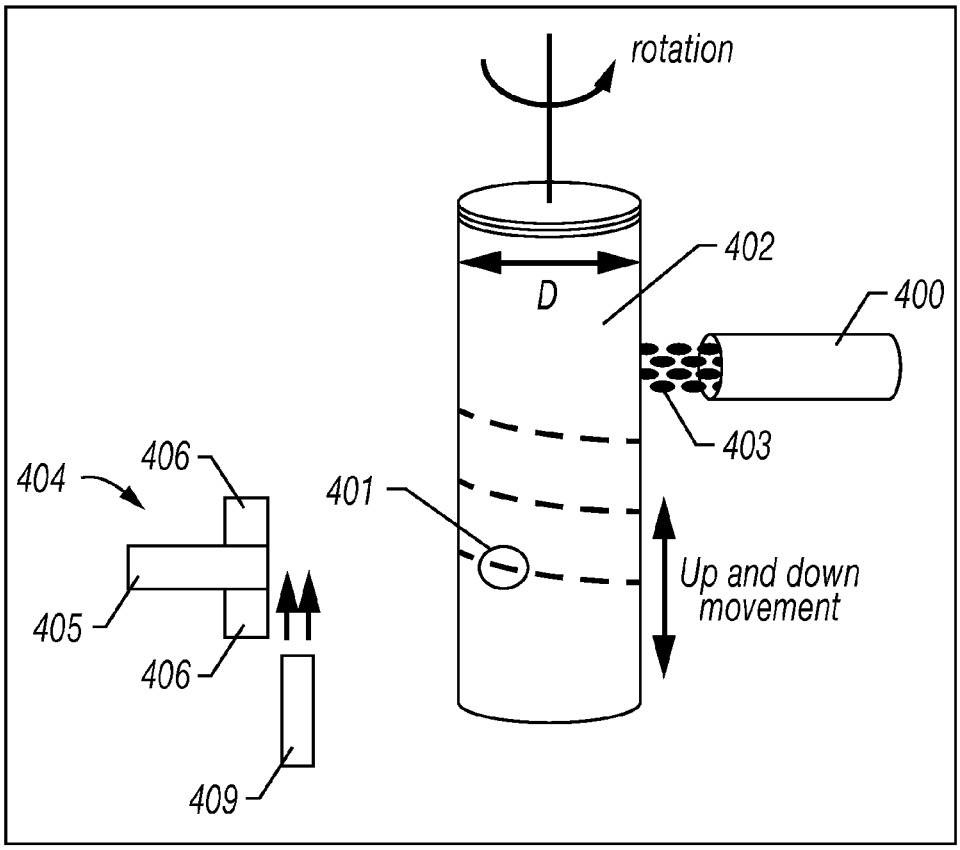

In general, as show in FIG. 4*a*, the remote sensing systems 200 include: marking equipment 400 for making a mark 401 on the drilling equipment 402 with a detectable substance 403, such as paint, radioactive dye, fluorescent dye, heat or infrared mark; detection equipment 404 (here shown to include a high-speed imaging system 405 and illumination system 406) for capturing data relating to at least a first and second position of the mark as it moves through the field-of-view of the detector and from which, for example, the rotational movement rate, longitudinal movement rate or both of the drilling equipment can be estimated; and, processing equipment (not shown, but shown in FIG. 1) for analyzing the captured data for information relating to the movement and/or geometry of the drilling equipment 402. The systems may also include cleaning equipment 407 (including cleaning fluid 301, a cleaning fluid injector 409, and guard/cap 300) (FIG. 3) for cleaning the detection equipment 404, especially elements of the equipment which are used to detect the mark 401 (such optical elements of a camera). Although the specification describes primarily the use of a high-speed camera (for example a high-speed video camera) as the detection system combined with an injector for spraying paint as the marking system and a fluid flowing system as protective barrier for the detector (e.g camera lens), this disclosure includes other embodiments, which a person of skill could envision as a result of reading this disclosure (such as an injector for applying a radioactive dye as the marking equipment and a radioactive detector as the detection system).

In general, the remote sensing methods involve making a mark 401 on a drilling equipment (a drill pipe is illustrated) 402 with a detectable substance 403 such as paint, radioactive dye, fluorescent dye and using a detector to detect the mark 401 and capturing data relating to the mark 401 in at least two different locations as the mark 401 moves through the field of view of the detector 404 (for example the detector may capture a first set of data relating to a first position of the mark in the field of view and a second set of data relating to a second position of the mark in the field of view). The data can then be used to analyze the movement of the drill pipe, for example the longitudinal movement, the rotational movement or both. For example if the detector detects a first set of data associated with a first position of the mark, a second set of data associated with a second position of the mark and the time of capture of the first set of data and the time of capture of the second set of data, rate of rotational movement and rate of longitudinal movement may be estimated.

Figure 4B:
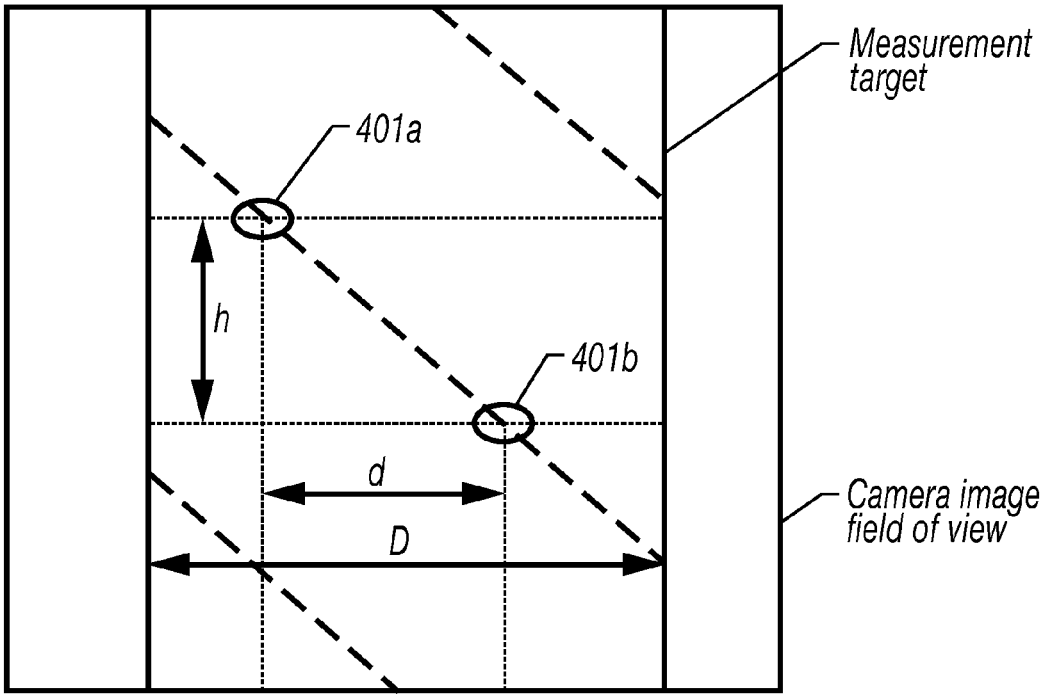
FIG. 4*b* is a close-up schematic illustration of a portion of the dill pipe in the field of view of the imaging equipment of FIG. 4*a*.

As a further example, as shown in FIG. 4*b* (which is a close-up schematic illustration of a section of drill pipe, with diameter "D", within the field of view of the detection equipment 404), when the camera 405 is a high-frame rate (high-speed) camera, it may capture data for a first position of the mark 401*a* at t1 and a second position of the mark 401*b* at t2. In the case of a high-speed camera, the time difference (t2−t1) between each image frame may be small hence the mark will only displace in a small longitudinal distance, "d" and small vertical distance, "h". When the distance d is small enough, the distance d measured from the images by image processing can be used to calculate the rotational speed using equation 1 as follows:

$$\omega_{cyc}=d/[\pi D(t_2-t_1)]\text{cycle}/s \quad (1).$$

Vertical displacement speed ($V_h$) may be calculated according to equation 2 as follows:

$$V_h=h/(t_2-t_1) \quad (2)$$

Figure 2:
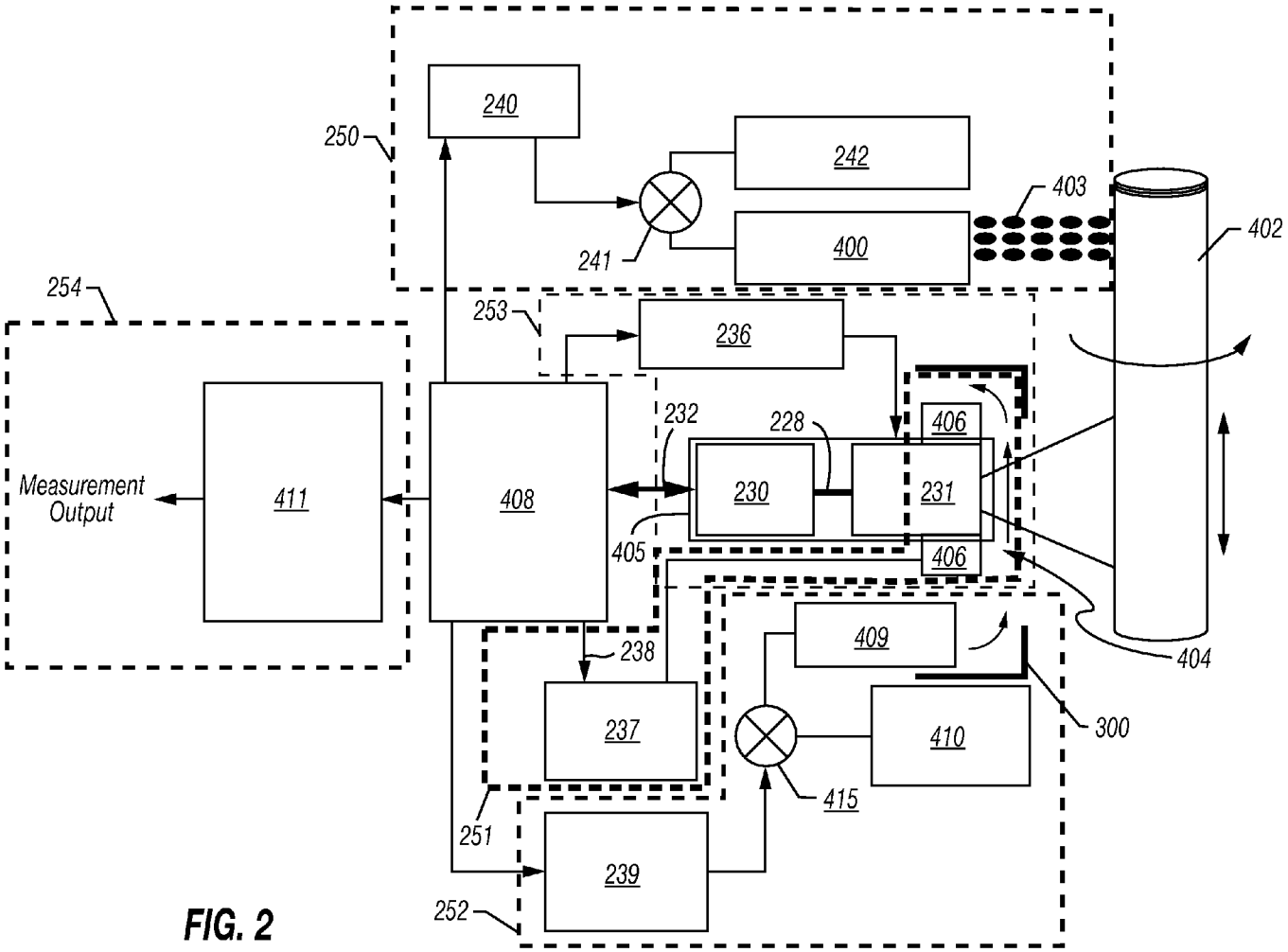
FIG. 2 is a block diagram illustrating an embodiment of a remote imaging sensing system, which may be used to capture data for analyzing information pertaining to drilling equipment such as the movement of the drilling equipment.

FIG. 2 is a more detailed schematic illustration of an embodiment of a remote sensing system 200 according to this disclosure. The illustrated remote sensing assembly 200 includes one detection system 404 (but can be expanded to multiple imaging systems). The detection system 404 includes an imaging device 405 and illumination sources 406. The imaging device comprises a photodetector array 231 which generates imaging measurement signals 228 to be provided to a corresponding processing element array (image processor) 230. The imaging device 405 can be implemented by one or more positionable (e.g., movable, adjustable, rotateable, etc.) detectors or imaging sensors, for example one or more positionable cameras. In some embodiments, the image processor includes a plurality of photo detectors comprising an array facilitating capturing 2-D data. In some embodiments, the imaging device 405 is a high-speed camera or video camera capable of taking at least two pictures of the marked section of a target (e.g. drill pipe) as it moves through the camera's optical field-of-view. The greater the amount of data (for example the larger the number of pictures) corresponding to the marked drill pipe, the more information will be available for analyzing the movement of the drilling equipment, resulting in more accurate estimates.

The imaging sensor and illumination source are chosen to correspond to the mark being detected. For example, if the mark being detected is a paint, the detector may be a camera and the illumination source a source of visible light. As another example, if the mark being detected is a fluorescent dye, the detector may be a fluorescence detector and the illumination system may be a source of ultraviolet light. As yet another example, if the mark being detected generates heat (distinguishable from the drilling equipment) then the detector may be an infrared detector and the illumination source a source of infrared for detecting heat.

In some embodiments, remote sensing systems 200 in accordance with this disclosure may include only a single detection system 404, for example, and consequently only a single imaging device 405. In some embodiments, the remote sensing systems 200 in accordance with this disclosure may include an additional detection system (in addition to 404), for example, and consequently an additional imaging device 405.

In the illustrated example, the processing element array (image processor) 230 processes the measurement signals 228 to estimate longitudinal movement rate, rotational movement rate or both and/or geometrical shape (e.g. diameter, length). In some embodiments, for example wherein the imaging sensor (processor) 230 comprises multiple photodetectors, the processor 230 may include a processing element associated with each photodetector, which may process data obtained from its respective photodetector and at least one neighboring photodetector. In the system 200 of FIG. 2, multiple imaging systems 404 can be used to capture two-dimensional positioning data taken from different angles of view. This two-dimensional positioning data may be included in the respective measurement signals 228 provided by each of the multiple imaging systems 404 to the processor 230 (FIG. 2 only shows a single imaging system 404). The processor 230 may then combine the two-dimensional positioning data included in the received measurement signals 228 using any appropriate technique to determine three-dimensional positioning data.

In the illustrated example, the signal(s) 232 may also be provided to an example imaging assembly controller (main controller) 236, which may be communicatively coupled to the various subsystems (such as the illumination system 251, the detection system 253, the protective fluid flow system 252, the detectable spray system 250, and the modem and communication system 254 which may transmit measurements in real-time to surface) of the remote sensing system for control and/or coordination. For example, the main controller 408 may be used in implementing feedback control of the imaging system 404 included in the remote sensing assembly 200. For example, the positioning data (target movement) included in the feedback signal(s) 232 can be used by the main controller 408 to send a control signal to the imaging assembly controller 236 using any appropriate feedback control algorithm to produce respective control signals 238 to control the orientation (e.g., angle, focal length, etc) of the imaging systems 404. For example, the control signals 238 can be used to adjust the optical field-of-view of the positionable imaging device 405 thereby enabling images of the target object 401 to be captured at appropriate angles. Additionally or alternatively, the control signals 238 can be used to adjust the orientation, intensity, etc., of the positionable light sources 406 illuminating the field-of-view of the imaging device 405 via an illumination/lighting controller 237.

In some embodiments the remote sensing system 200 comprises a means for cleaning detection equipment, as for example operation at surface (rig floor) may result in contamination of the equipment (such as an optical surface) from the surroundings (such as spill of mud, oil etc.). To prevent contamination, transparent fluid such as a non-combustible gas (e.g. CO2, N2) may be made to continuously flow in front of the imaging assembly optical surface to create a barrier to repel any dirty fluid/debris from flying into the optical surface keeping the optical surface clean even in dirty conditions such as may be present on the rig floor. In other embodiments, the fluid may be intermittently injected across the detection equipment to clean it up after contamination. FIG. 3 is a schematic illustration of an embodiment of cleaning detection system suitable for use with remote sensing systems of this disclosure. As shown, the system includes a guard or protective cap 300 fitted around the detection equipment 404, providing a gap between the detection equipment 404 and the guard 300, directing flowing fluid 301, injected inside the guard by an injector 409, around the optical elements of the camera and repelling debris 302—thereby creating a protective barrier of flowing fluid.

Turning back to FIG. 2, in the illustrated example system, the main controller 408 may also send control signals to the Protective Fluid Valve Controller 239 (part of the system for cleaning the detection equipment 253) to enable a continuous protective barrier of fluid flowing in front of the detector 405. The illustrated Protective Fluid Injector 409 may project fluid flowing to protect the detector from getting dirty and/or for cleaning the detector, such as cleaning optical fields-of-view or cleaning the optics (e.g., windows, lenses, etc.) when the imaging device 405 is a camera. In some examples, the flowing fluid is obtained from a Protective fluid reservoir 410. The flowing fluid may be, for example, a non-combustible gas such as nitrogen, CO2 or water or some other substantially transparent fluid, etc. The main controller 408 may operate a flowing fluid valve 415 to turn the flow of fluid on and off.

In the illustrated example of FIG. 2, the Main Controller 408 may also send a control signal to the Spray Valve Controller 240. The Spray Valve Controller 240 controls the spraying valve 241 to open or close the flow between Detectable Substance Container 242 and Detectable Substance Spray Injector 400 hence allowing the detectable substance (paint etc) 403 to be sprayed out to create a mark 401 on the surface of target (drill-pipe etc) 402. The Spraying Valve Controller 240 of the illustrated example controls the times at which the valve 241 is opened and closed to control times and durations of spraying.

In some examples, the light sources 406 of the imaging systems 404 can correspond to fluorescent lighting sources. In some examples, the imaging systems 404 can support multiple light sources 406 with different angles of lighting. In some examples, the imaging systems 404 include a light focusing device (e.g., adjustable lens, mirrors, etc.) positioned and controllable by the imaging assembly controller 236 to adjust the light emanating from the light sources 406.

Figure 5A:
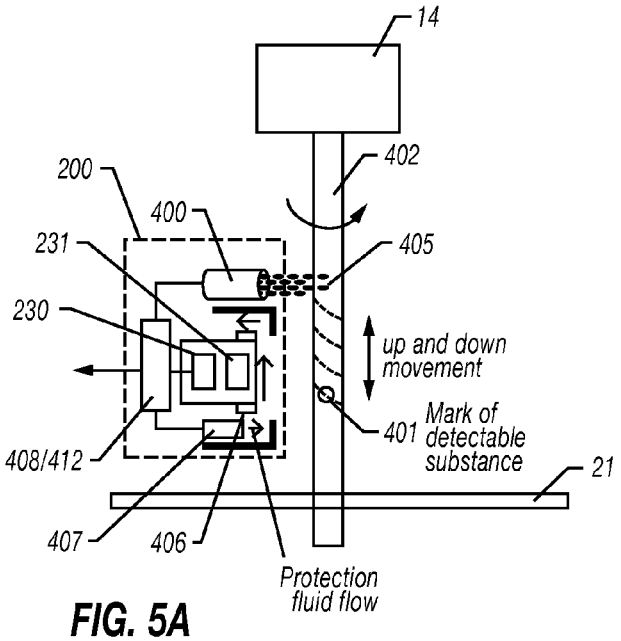
FIG. 5*a* is a schematic illustration of an embodiment of the remote sensing assembly of FIG. 2 configured for use at surface.

The remote sensing system 200 may be configured for use at surface or downhole. FIG. 5 illustrates an embodiment of a remote sensing system 200 configured for use at surface, and method of use of such a surface system. FIG. 6 illustrates a remote sensing system 200 configured for use downhole, and a method of use of such system downhole. In some embodiments, portions of the remote sensing system may be at surface (e.g. the marking equipment) and portions may be downhole (e.g. the detection equipment) or portions may be both at surface and downhole.

Turning again to FIG. 5*a*, the imaging assembly 200 is positioned at the surface such as to observe drill-pipe between the rotary swivel 19 or the top drive and rig floor 21. Although drill-pipe is illustrated in FIG. 5*a*, the same assumption can be made for other targets, such as logging cable, coiled tubing etc. The spray injector 400 will spray paint or detectable substance 403 on the drill-pipe 402 surface to create a mark 401 to allow the imaging assembly 400 to detect the rotational and longitudinal and rotational movement of the drill-pipe 402. Furthermore, besides measuring longitudinal and rotational movement of the drill-pipe 402, the imaging assembly 200 also can measure the shape or geometrical information of the drill-pipe 402 such as diameter D, of the drill-pipe 402 and length, L, of the drill-pipe 402 section at real-time in the function of time (e.g. diameter profile D(t) and length L of drill-pipe).

Figure 5B:
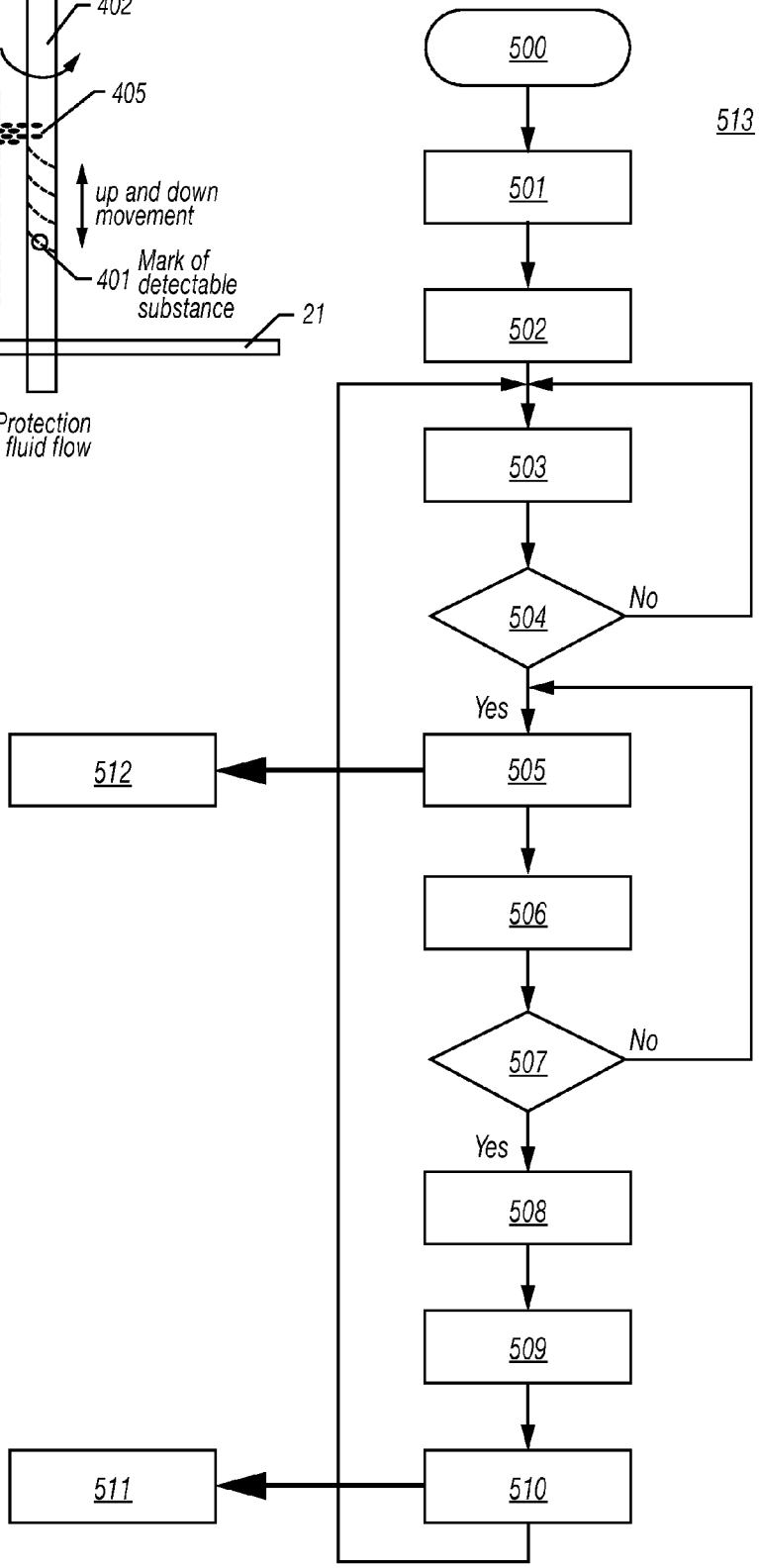
FIG. 5*b* is a flow diagram of a method of using the at surface remote sensing assembly of FIG. 5*a*.

The flowchart of FIG. 5*b* illustrates an embodiment of a measurement process using imaging assembly 200 positioned at surface. At the start of the process 500, the projection fluid injector flows cleaning fluid 501 over the detection equipment, and the illumination system is turned on 502 to illuminate the target. An image is thereafter captured 503 by the detection equipment. Image capture is repeated if the target (drill pipe) is not in the field of view 504. Otherwise, the image data is processed to measure target geometry 505 (which information may be output in real time 512) followed by injecting a detectable substance onto the target (drill pipe) 506. Image capture is repeated if the mark is not detected in the field of view 507, otherwise, multiple images of the mark are captured 508 as it moves through the field of view and the captured image data is processed to measure vertical and rotational displacement 509. Vertical Displacement speed and rotational speed are thereafter calculated 510 and may be output in real time 511.

Figure 6A:
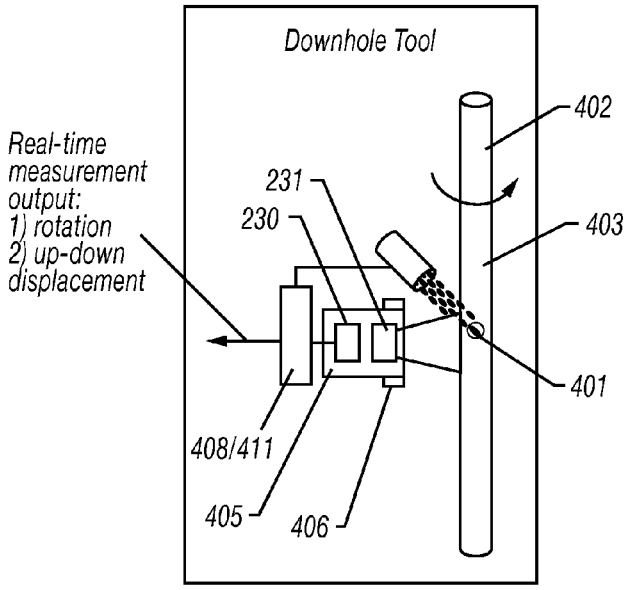
FIG. 6*a* is a schematic illustration of an embodiment of the remote sensing system of FIG. 2 configured for use downhole.
Figure 6B:
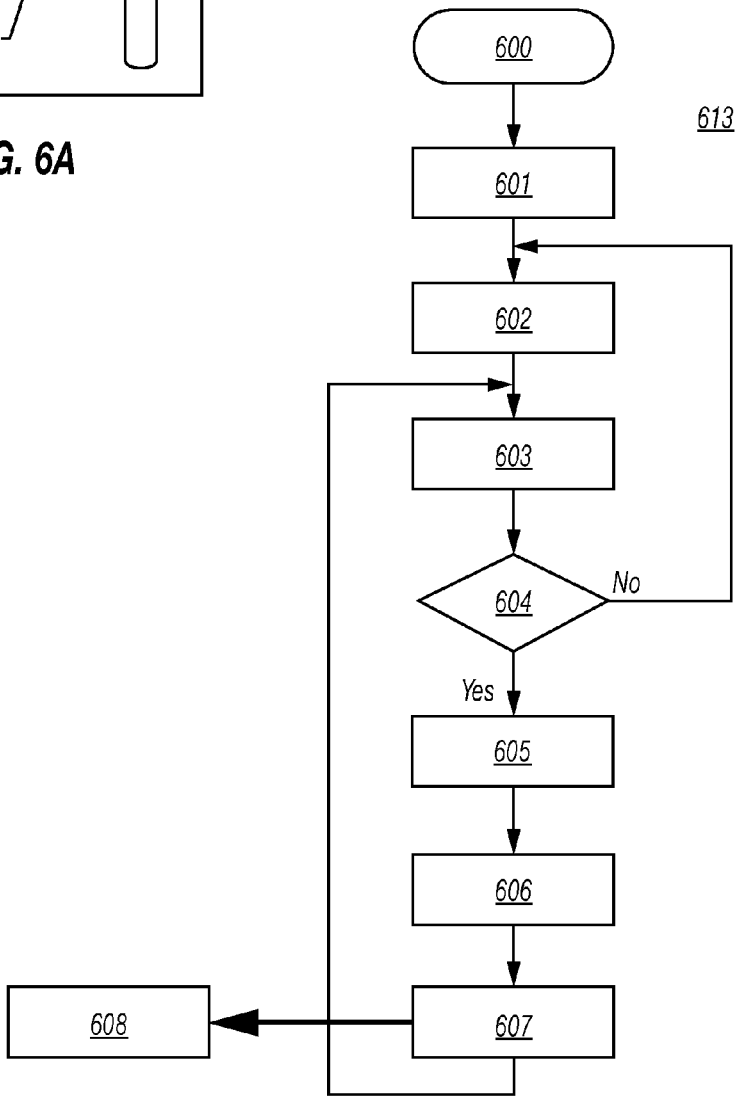
FIG. 6*b* is a flow diagram of a method of using the downhole remote sensing assembly of FIG. 6*a*.

Turning now to FIG. 6*a*, the imaging assembly 200, or portions thereof, may alternatively be positioned downhole. In the illustrated embodiment, the remote sensing assembly is located inside a downhole tool for measurement of characteristics of an internal moving mechanical part. A method of making and analyzing measurements corresponding to an internal moving part using the remote sensing assembly of FIG. 6*a* is illustrated by the flow diagram of FIG. 6*a*. As shown, at the start 600, the illumination system is turned on to illuminate the target (such as a moving mechanical part for example the shaft of a motor inside a bottom hole assembly) 601. A detectable substance is injected onto the target 602. An image is thereafter captured of the target 603. If the mark made by the detectable substance is not detected, the process of spraying the target and capturing an image is repeated 604. Otherwise, the detection equipment captures multiple images of the mark before it leaves its field of view 605. Image processing is performed to measure vertical displacement and rotational displacement 606. Vertical displacement speed and rotational speed of the target (e.g. motor shaft) are calculated from the vertical displacement and rotational displacement results 607 and the information may be transmitted to surface real time 608. In addition, movement at any direction (longitudinal etc) of a downhole moving part (such as a valve etc) may be calculated. In the downhole case wherein the remote sensing equipment is located inside a downhole tool, the protective flow fluid may not be needed but it can be included if desired, for example if there is a dirty environment.

Although a few example embodiments have been described in detail above, those skilled in the art will readily appreciate that many modifications are possible in the example embodiments without materially departing from this invention. For example, as mentioned, the imaging system is not limited to the main example provided but could be any camera and, particularly any camera that can capture at least two sets of data corresponding to the movement of the marked drill pipe (for example a first set of data relating to a first position of the mark and a second set of data relating to a second position of the mark) as it moves through the camera's field of view. Alternatively, the imaging system may not be a camera at all but rather the appropriate detector corresponding to the detectable substance used to mark the drill pipe such as for example an x-ray detector if the detectable substance is a radioactive dye or a fluorescence detector if the detectable substance is a fluorescent stain. And, whereas, the main example provides for an imaging assembly configured for use at the surface, the system may also be modified for use downhole. Accordingly, all such modifications are intended to be included within the scope of this disclosure as defined in the following claims. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Finally, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method for analyzing movement of drilling equipment, comprising:

a. marking oil and gas exploration equipment with a detectable substance resulting in a mark;

b. providing a detector having an optical component, a field-of-view, and a cap spaced apart a distance from the optical component;

c. continuously injecting a fluid across the optical component wherein the cap is configured to direct the continuously flowing fluid around the optical component;

b. capturing a first set of data relating to the mark when the mark moves through the field-of-view and is at a first location in the field-of-view;

c. capturing a second set of data relating to the mark with the detector when the mark continues to move through the field-of-view from the first location to a second location; and, d. estimating at least one of longitudinal movement rate, rotational movement rate, and geometry of the drilling equipment from the first data and the second data.

2. A method according to claim 1, wherein the equipment is chosen from: drilling pipe, coiled tubing, slick line, and logging cable.

3. A method according to claim 1, wherein the detector captures at least the first set of data and second set of data before the mark leaves the field-of-view.

4. A method according to claim 1, wherein the first set of data and second set of data is processed in real-time and results in an estimate of one or more of the longitudinal movement rate, rotational movement rate, or both of the equipment.

5. A method according to claim 1, wherein the set of data captured is used to measure diameter, length profile, or both of the equipment.

6. A method according to claim 1, wherein the detector comprises a plurality of photodetectors, and estimating comprises using a processor comprising a plurality of processing elements, wherein each of the plurality of processing elements corresponds to a photodetector and each of the plurality of processing elements process the first data and the second data from each of the plurality of processing elements' corresponding photodetector and at least one neighboring photodetector facilitating determination of 2-D data.

7. A method according to claim 1, wherein the detector is multiple photodetector arrays for capturing images from different angles of view.

8. A method according to claim 1, wherein the detectable substance is a spray paint and marking comprises injecting spray paint onto the equipment using a spray paint injector.

9. A method according to claim 1, wherein the equipment has a surface temperature and the detectable substance has a temperature different from the surface temperature and the detector is an infrared light detector.

10. A method according to claim 1, where the detectable substance is a substance emits both visible and multiple wavelengths of light.

11. A method according to claim 1, wherein the detectable substance is a fluorescent dye and the detector is a fluorescence light detector.

12. A system for detecting movement of a drilling equipment downhole, comprising:

a. a detector configured for use downhole, comprising:
   an optical component;
   a cap spaced apart from the optical component and configured to direct continuously flowing fluid around the optical component; and
   a field of view;

b. a detectable substance;

c. an injector for marking the drilling equipment with the detectable substance;

d. a processor for estimating longitudinal movement rate, rotational movement rate, or both of the drilling equipment from data captured by the detector.

13. A system according to claim 12, wherein the detector is an imaging module comprising: a plurality of photo detectors capable of capturing at least a first set of data relating to a first position of the detectable substance in the field-of-view and a second set of data relating to a second position of the detectable substance in the field of view as the detectable substances passes through the field-of-view.

* * * * *